US011795747B2

(12) United States Patent
Rojas et al.

(10) Patent No.: US 11,795,747 B2
(45) Date of Patent: Oct. 24, 2023

(54) VEHICLE DOOR HINGE

(71) Applicant: Rivian IP Holdings, LLC, Plymouth, MI (US)

(72) Inventors: Victor Daniel Rojas, Hermosa Beach, CA (US); Carlos Chon, Northville, MI (US); Kostandinos Papanikolaou, Huntington Woods, MI (US); Julio Cesar Maldonado Cruz, Canton, MI (US); Marcus Merideth, Westland, MI (US)

(73) Assignee: Rivian IP Holdings, LLC, Plymouth, MI (US)

( * ) Notice: Subject to any disclaimer, the term of this patent is extended or adjusted under 35 U.S.C. 154(b) by 80 days.

(21) Appl. No.: 17/360,481

(22) Filed: Jun. 28, 2021

(65) Prior Publication Data

US 2022/0412141 A1 Dec. 29, 2022

(51) Int. Cl.
*E05D 11/10* (2006.01)
*E05D 5/06* (2006.01)

(52) U.S. Cl.
CPC ..... *E05D 11/1085* (2013.01); *E05D 5/062* (2013.01); *E05Y 2900/531* (2013.01)

(58) Field of Classification Search
CPC . E05D 11/10; E05D 11/1028; E05D 11/1078; E05D 11/1085; E05D 11/1007; E05D 11/1014; E05D 2011/1035; E05D 5/06; E05D 5/062
See application file for complete search history.

(56) References Cited

U.S. PATENT DOCUMENTS 1,044,055 A * 11/1912 Johnson et al. .... E05D 11/1078 403/380
1,115,450 A * 10/1914 Parizek ..... E05D 11/1078 16/329
1,137,706 A * 4/1915 Delaney ..... E05D 11/1078 16/329
1,159,529 A * 11/1915 Parizek ..... E05D 11/1078 16/329
1,207,270 A * 12/1916 Braithwaite ..... E05D 11/1078 16/329
1,212,475 A * 1/1917 Gillies ..... E05D 11/1078 16/329
1,482,954 A * 2/1924 Tideman ..... B60B 33/04 280/43

(Continued)

*Primary Examiner* — Jeffrey O'Brien
(74) *Attorney, Agent, or Firm* — Clements Bernard Walker; Christopher L. Bernard

(57) ABSTRACT

Various disclosed embodiments include illustrative hinges, door assemblies, storage bins, and vehicles. In an illustrative embodiment a hinge includes a hinge bracket, a hinge pin, a hinge arm, and a detent assembly. The hinge arm is rotatably connected to the hinge bracket via the hinge pin. The detent assembly is adapted to define a detent position of the hinge arm relative to the hinge bracket that is between an open position and a closed position of the hinge arm relative to the hinge bracket. The detent assembly includes a detent plate and a plunger assembly. The detent plate includes a recess formed therein. The plunger assembly includes an end that is biased at least partially into the recess while circumferentially aligned therewith to define the detent position.

20 Claims, 9 Drawing Sheets

(56) References Cited

U.S. PATENT DOCUMENTS 2,427,384 A * 9/1947 Bushko ..... E05D 5/10 16/325
2,635,281 A * 4/1953 Feldberg ..... E05D 11/1078 16/329
RE28,355 E * 3/1975 Petri ..... F16B 21/165 403/328
4,794,669 A * 1/1989 Sanders ..... E05D 11/1057 16/375
4,800,624 A * 1/1989 Whitefoot ..... E05D 11/1057 16/86 A
5,143,468 A * 9/1992 Pausch ..... F16C 11/10 16/322
5,412,842 A * 5/1995 Riblett ..... E05D 11/1064 16/322
5,689,999 A * 11/1997 Wiley ..... F16C 11/10 403/107
5,918,347 A * 7/1999 Morawetz ..... E05D 11/1071 16/322
5,988,724 A * 11/1999 Wolda ..... E05F 1/1238 49/386
6,000,098 A * 12/1999 Kluting ..... E05D 11/1085 16/322
6,012,201 A * 1/2000 Mitts ..... E05D 11/1085 16/334
6,092,334 A * 7/2000 Kim ..... E05F 1/006 16/334
6,532,627 B2 * 3/2003 Audisio ..... E05D 11/1085 16/322
6,581,245 B2 * 6/2003 Jen ..... E05B 1/0015 16/334
6,708,370 B2 * 3/2004 Shih ..... G06F 1/1679 16/335
6,817,062 B2 * 11/2004 Cho ..... C08L 23/10 16/334
6,832,411 B2 * 12/2004 Koshikawa ..... H04M 1/0216 16/303
6,904,644 B2 * 6/2005 Oshima ..... G06F 1/1679 16/303
6,948,217 B2 * 9/2005 Higano ..... G06F 1/1679 16/303
6,981,330 B2 * 1/2006 Tieszen ..... G01C 9/36 33/379
6,990,711 B2 * 1/2006 Koshikawa ..... H04M 1/0216 16/334
7,103,938 B2 * 9/2006 Bruckner ..... E05D 11/1085 16/334
7,338,107 B1 * 3/2008 Wilcox ..... E05D 3/022 296/57.1
7,533,449 B2 * 5/2009 Hsu ..... H04M 1/0212 16/376
7,536,749 B2 * 5/2009 Lu ..... G06F 1/1681 16/340
7,805,811 B2 * 10/2010 Shuker ..... E05D 5/128 16/382
8,510,913 B2 * 8/2013 Kim ..... E05D 11/1028 16/334
8,578,560 B1 * 11/2013 Swinehart ..... A61G 5/1091 16/326
10,619,390 B2 * 4/2020 Suesada ..... E05D 5/062
11,162,290 B2 * 11/2021 Favero ..... E05B 83/24
2005/0032559 A1 * 2/2005 Sudo ..... H04M 1/0216 455/575.3
2007/0011848 A1 * 1/2007 Lu ..... G06F 1/1681 16/340
2011/0099756 A1 * 5/2011 Chen ..... G06F 1/1618 16/297
2011/0099757 A1 * 5/2011 Chang ..... G06F 1/1681 16/297
2012/0140388 A1 * 6/2012 Ahn ..... E05D 11/04 361/679.01
2014/0259532 A1 * 9/2014 Millard ..... E05D 11/1028 16/326

* cited by examiner

VEHICLE DOOR HINGE

INTRODUCTION

The present disclosure relates to a hinge for a vehicle door.

Vehicles adapted for use in rugged terrain and climates are often used for traveling to and from activities that entail various types of equipment. Such vehicles are tasked with hauling and securing this equipment while maintaining safety of the operator and preventing damage to the vehicle and to other surrounding objects.

Storage spaces may be positioned within the interior of such vehicles or within an interior region of a bed (such as a truck bed) of such a vehicle. Such spaces may not be easily accessible from outside the vehicle and may not be secure (such as a truck bed).

The present background is provided by way of illustrative environmental context only. It will be readily apparent to those of ordinary skill in the art that the principles of the present disclosure may be implemented in other environmental contexts equally.

BRIEF SUMMARY

Various disclosed embodiments include illustrative hinges, door assemblies, storage bins, and vehicles.

In one illustrative embodiment of the present disclosure, a hinge is disclosed. The hinge includes a hinge arm and a detent assembly. The hinge arm is rotatably connected to a hinge bracket via a hinge pin. The detent assembly is adapted to define a detent position of the hinge arm relative to the hinge bracket that is between an open position and a closed position of the hinge arm relative to the hinge bracket. The detent assembly includes a detent plate and a plunger assembly. The detent plate includes a recess formed therein. The plunger assembly includes an end that is biased at least partially into the recess at the detent position.

In another illustrative embodiment of the present disclosure, a door assembly is disclosed. The door assembly includes a door and a hinge. The door is adapted to provide access to a storage bin. The hinge includes a hinge bracket, a hinge arm, and a detent assembly. The hinge bracket is adapted to connect to a structure. The hinge arm is rotatably connected to the hinge bracket via a hinge pin and is connected to the door. The detent assembly is adapted to define a detent position of the door that is between an open position and a closed position of the door. The detent assembly includes a detent plate and a plunger assembly. The detent plate includes a recess formed therein. The plunger assembly includes an end that is biased at least partially into the recess at the detent position.

In a further illustrative embodiment of the present disclosure, a vehicle is disclosed. The vehicle includes a storage bin, a door, and a hinge. The storage bin is accessible at an exterior of the vehicle. The door is adapted to provide access to the storage bin. The hinge includes a hinge bracket, a hinge arm, and a detent assembly. The hinge bracket is adapted to connect the vehicle. The hinge arm is rotatably connected to the hinge bracket via a hinge pin and is connected to the door. The detent assembly is adapted to define a detent position of the door that is between an open position and a closed position of the door. The detent assembly includes a detent plate and a plunger assembly. The detent plate includes a recess formed therein. The plunger assembly includes an end that is biased at least partially into the recess at the detent position.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The present disclosure is illustrated and described herein with reference to the various drawings, in which like reference numbers are used to denote like system components/method steps, as appropriate, and in which.

DETAILED DESCRIPTION

Given by way of non-limiting overview, various disclosed embodiments include illustrative hinges, door assemblies, storage bins, and vehicles. Given by way of non-limiting example provided by way of illustration only, the present disclosure provides, among other illustrative embodiments, an illustrative vehicle with a storage bin that includes a door connected to the vehicle via a hinge that is adapted to secure the door to a structure of the vehicle, such as a side panel of the vehicle, a frame of the vehicle, and the like. In embodiments, the hinge is secured to a bottom of the door and is adapted to guide the door to open outward and downward from the structure of the storage bin or vehicle. The hinge includes a detent assembly that is adapted to provide one or more detent positions for the door between the fully closed position of the door and the fully open position of the door.

By having one or more detents in the hinge, defined by the detent assembly, and that define detent positions for the door, the door can be opened under more control without the door slamming open due to the force of gravity, which slamming could impact the person opening the door or another vehicle or object next to the vehicle. Furthermore, with one or more detent positions, the door can be partially opened to access the contents in the storage bin without requiring that the person accessing the storage bin hold the door or operate a latch to keep the door in the partially opened state. In various embodiments, the storage bin is accessible from an exterior of the vehicle. Thus, detent positions that allow the door to be held partially open is particularly useful where space is limited between the vehicle and another object (such as another vehicle). The above overview is given by way of illustration only and is not intended to be limiting whatsoever. As such, no limitation is to be inferred.

Figure 1:
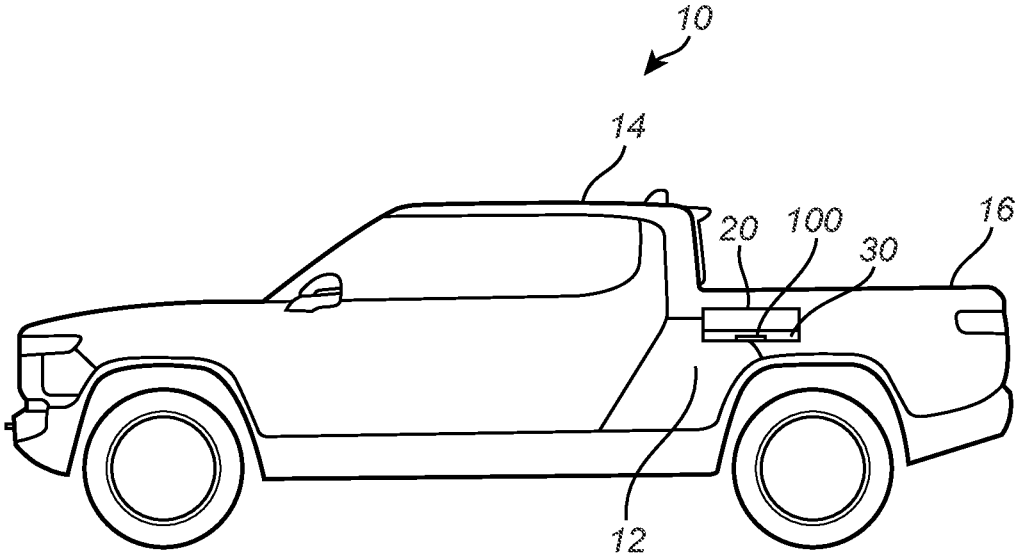
FIG. 1 is a perspective view of an illustrative embodiment of a vehicle of the present disclosure, highlighting a storage bin positioned in a side of the vehicle where the storage bin includes a door and a hinge thereof.

FIG. 1 is a perspective view of an illustrative embodiment of a vehicle 10 of the present disclosure, highlighting a storage bin 20 positioned in a side of the vehicle 10 where the storage bin 20 includes a door 30 and a hinge 100 thereof. Referring now specifically to FIG. 1, in various illustrative embodiments, the vehicle 10 includes at least one storage bin 20. In the embodiment illustrated, the storage bin 20 is a side bin positioned at a side panel 12 of the vehicle 10 and accessible from an exterior of the vehicle 10. In particular, in the embodiment illustrated, the storage bin 20 is positioned in the side panel 12 of the vehicle 10 outside of a bed 16 of the vehicle, and behind a cab 14 of the vehicle.

The storage bin 20 includes a door 30 that is adapted to close and secure contents within the storage bin 20. In the embodiment illustrated, a bottom of the door 30 is secured to a structure of the vehicle at a side the side of the vehicle 10 via the hinge 100, the structure being, for example, the side panel 12 a frame of the vehicle 10, and the like. The hinge 100 is adapted to rotate the door 30 from a vertical orientation while in a closed position to a horizontal orientation while in an open position. While the embodiment illustrated in FIG. 1 shows the open position being at the horizontal orientation, in various other embodiments, the door 30 rotates beyond the horizontal orientation such that the door 30 rotates down further to the ground. In one embodiment, the door 30 rotates outward, away from the bed 16, and downward, relative to the storage bin 20/vehicle 10 towards the ground, but is stopped by the hinge 100 prior to contacting the side panel 12. As will be described in further detail below, the hinge 100 defines one or more detent positions between the open position and the closed position of the door 30.

Figure 2:
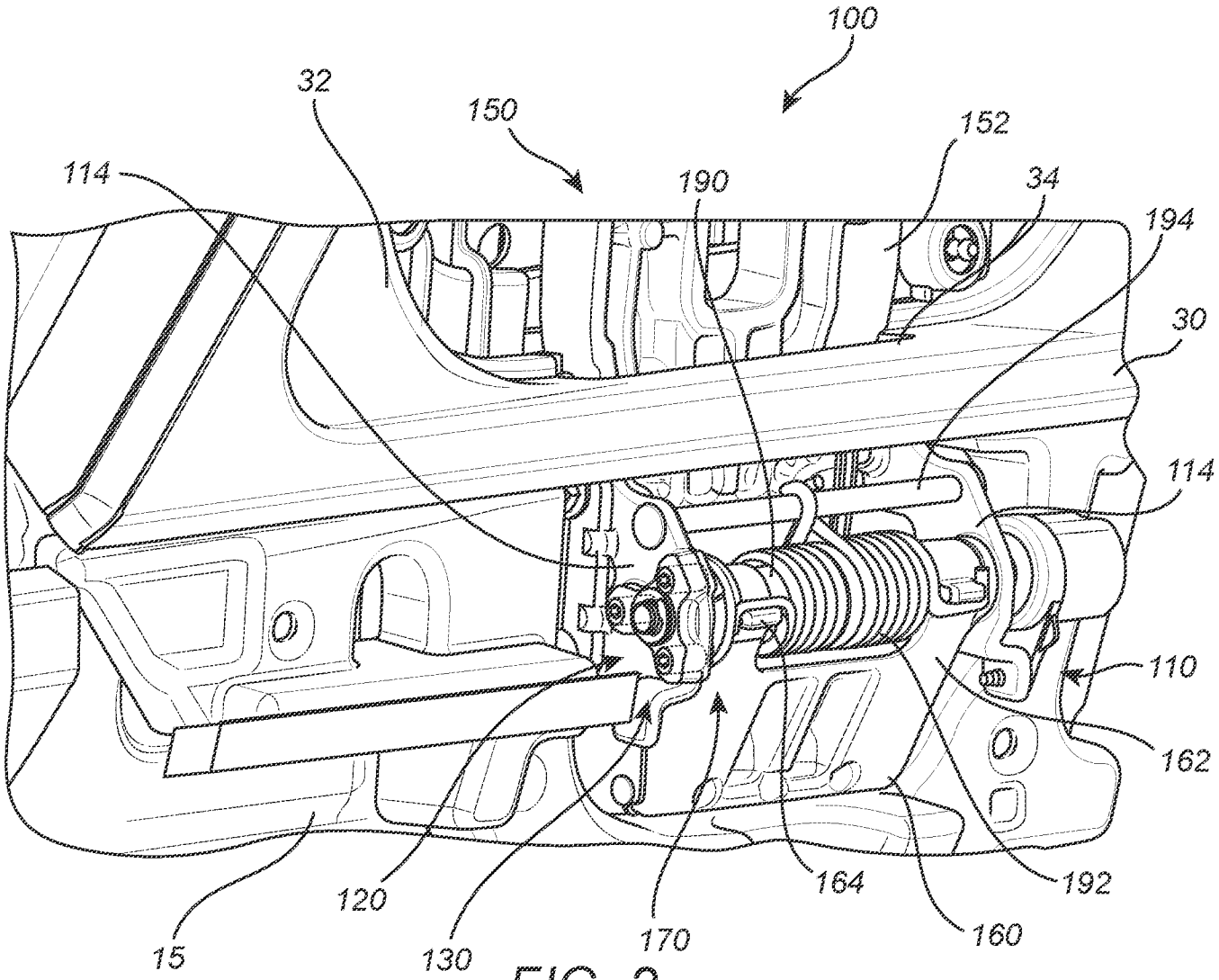
FIG. 2 is a detailed perspective view of a portion of the door and hinge of one illustrative embodiment of the present disclosure.

FIG. 2 is a detailed perspective view of a portion of the door 30 and hinge 100 of one illustrative embodiment of the present disclosure. Referring now specifically to FIG. 2, in various illustrative embodiments, the door 30 includes an opening 32 that can be utilized for securing the hinge 100 thereto. A panel can be placed over the opening, which is adapted to form a part of the side of the vehicle 10 while the door is in the closed position. In the embodiment illustrated in FIG. 2, the bottom of the door 30 includes a slot 34 for receiving the hinge 100.

As will be described in greater detail below (FIGS. 3-8), in various embodiments, the hinge 100 includes a hinge bracket 110, a hinge arm 150, a hinge pin 190, one or more springs 192, and a detent assembly 120. The hinge bracket 110 includes bracket arms 114 that are adapted to receive the hinge pin 190 and one or more base plates 112 (FIGS. 3-8), which are adapted for securing the hinge bracket 110 to the side of the vehicle 10, such as to the vehicle frame 15 or to a side panel 12 (FIG. 1). In various embodiments, the bracket arms 114 extend generally perpendicular to a respective base plate 112 and the base plates 112 extend outward from the respective bracket arms 114.

The hinge arm 150 includes an upper arm 152 and a lower arm 160. The lower arm 160 is rotatably coupled to the hinge bracket 110 via the hinge pin 190. In the embodiment illustrated, the lower arm 160 includes a mounting portion that extends outward, that is positioned between the bracket arms 114, and that is adapted to form the coupling between the hinge arm 150 and the hinge pin 190. The upper arm 152 extends from the lower arm 160, extends through the slot 34, and is adapted to be fastened to the door 30.

The detent assembly 120 is adapted to form one or more detent positions that catch the hinge arm 150 and keep the hinge arm 150 in the detent position until sufficient force is applied to release the hinge arm 150 for further movement thereof. As will be described in greater detail below, the detent assembly 120 includes a plunger assembly 130 and a detent plate 170 that are adapted with one or more catches for the one or more detent positions. While the embodiment illustrated shows the plunger assembly 130 mounted to the hinge bracket 110 and the detent plate 170 mounted to the hinge arm 150, in various other embodiments, the plunger assembly 130 is mounted to the hinge arm 150 and the detent plate 170 is mounted to the hinge bracket 110.

In the embodiment illustrated, the hinge 100 includes a tensioning pin 194 that is offset from the hinge pin 190 and that extends between the bracket arms 114 and the mounting portion 162 of the lower arm 160 includes a spring clip 164 for each spring 192. Each spring 192 includes an end attached to the tensioning pin 194, such as by a hook at an end of the spring 192 and an opposing end that attaches to a corresponding spring clip 164.

Figure 3:
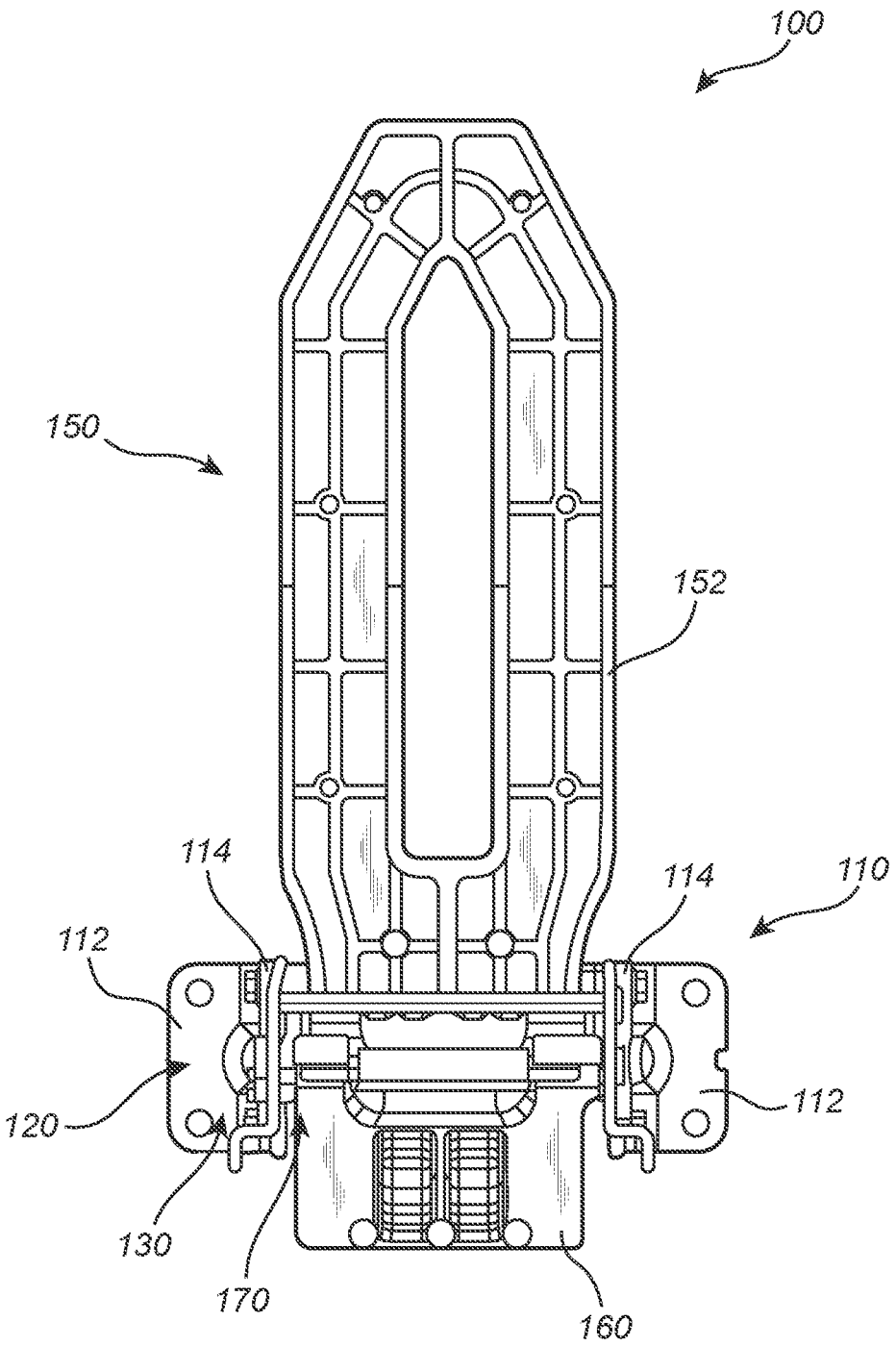
FIG. 3 is a front perspective view of one illustrative embodiment of the hinge of the present disclosure.
Figure 4:
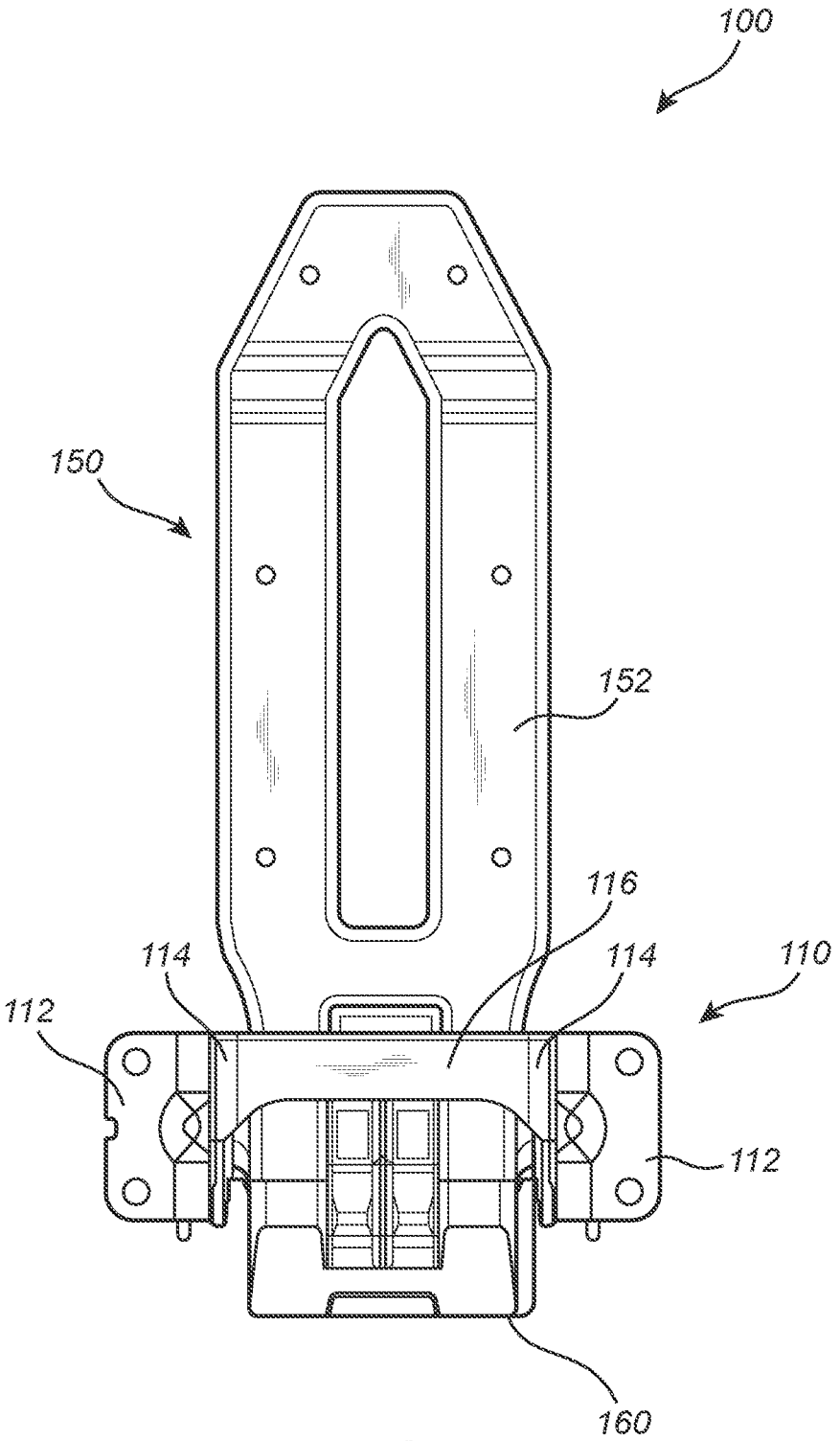
FIG. 4 is a back perspective view of the illustrative embodiment of the hinge of FIG. 3.
Figure 5:
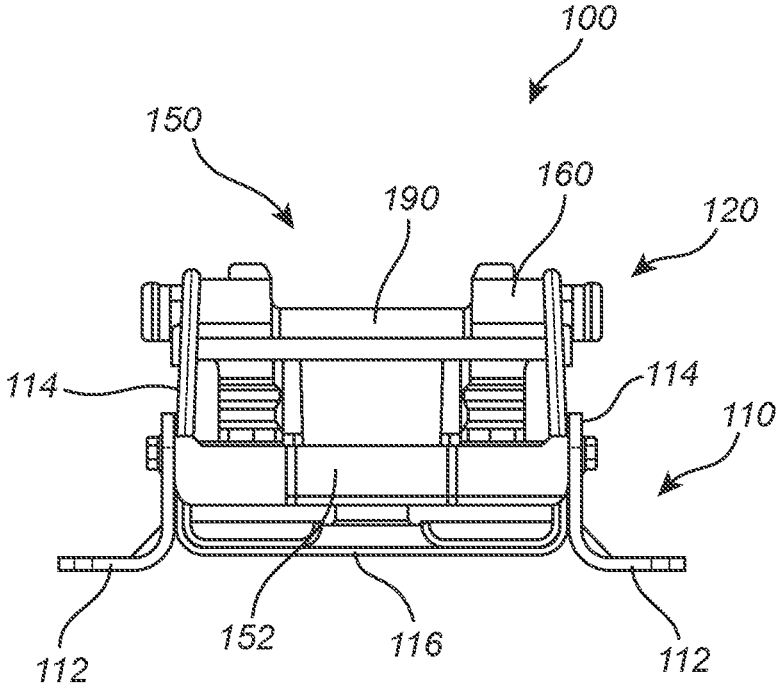
FIG. 5 is a top perspective view of the illustrative embodiment of the hinge of FIG. 3.
Figure 6:
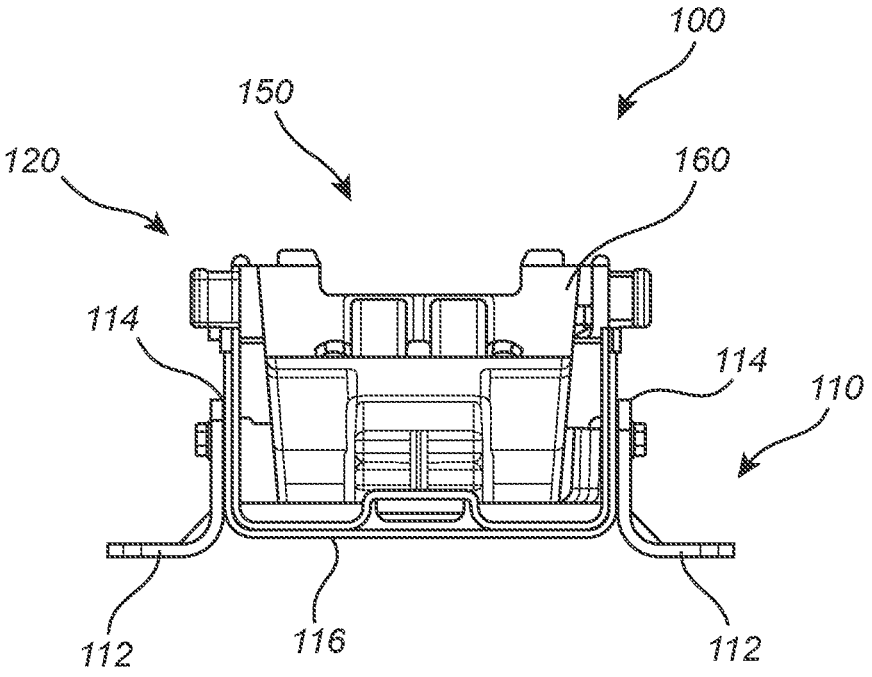
FIG. 6 is a bottom perspective view of the illustrative embodiment of the hinge of FIG. 3.
Figure 7:
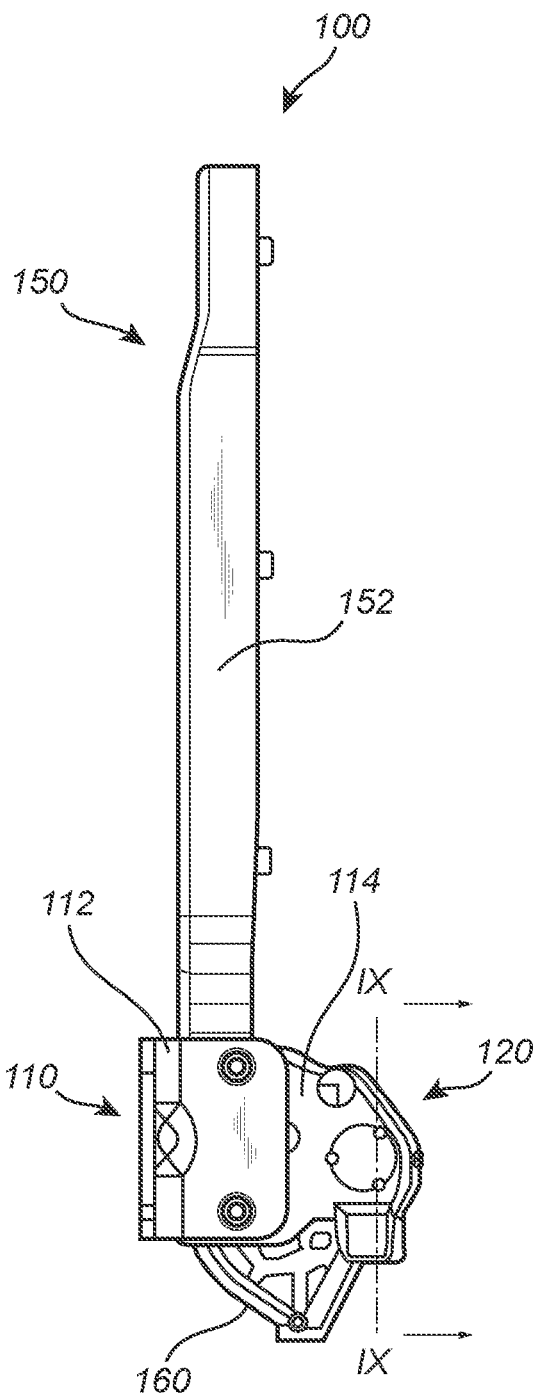
FIG. 7 is a side perspective view of the illustrative embodiment of the hinge of FIG. 3.
Figure 8:
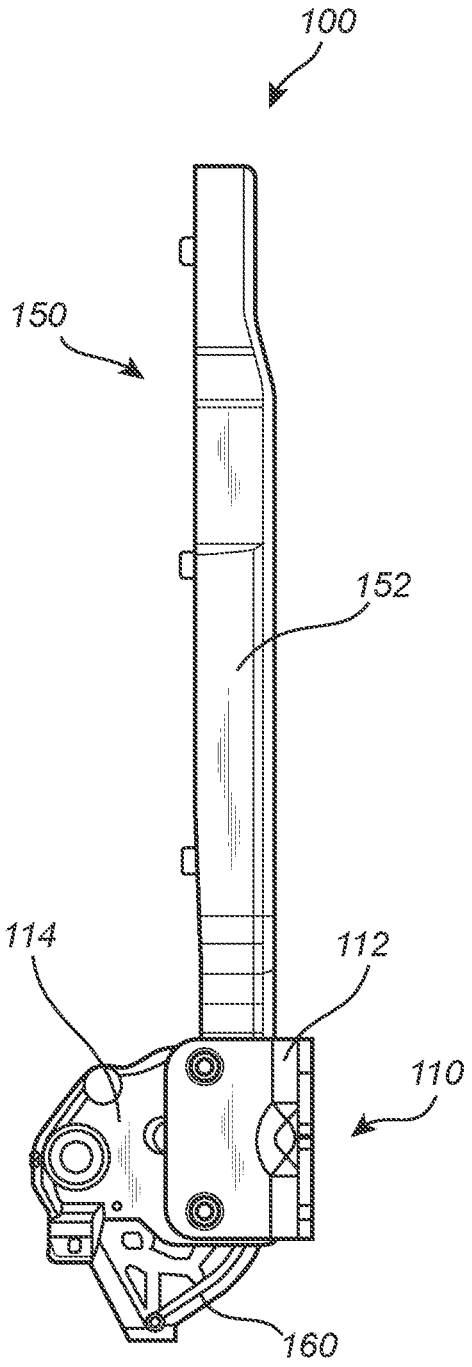
FIG. 8 is a side perspective view of the illustrative embodiment of the hinge of FIG. 3.

FIG. 3 is a front perspective view of one illustrative embodiment of the hinge 100 of the present disclosure. FIG. 4 is a back perspective view of the illustrative embodiment of the hinge 100 of FIG. 3. FIG. 5 is a top perspective view of the illustrative embodiment of the hinge 100 of FIG. 3. FIG. 6 is a bottom perspective view of the illustrative embodiment of the hinge 100 of FIG. 3. FIG. 7 is a side perspective view of the illustrative embodiment of the hinge 100 of FIG. 3. FIG. 8 is a side perspective view of the illustrative embodiment of the hinge 100 of FIG. 3. Referring now specifically to FIGS. 3-8, in various illustrative embodiments, the upper arm 152 of the hinge arm 150 generally includes a flat elongated shape extending from the lower arm 160. In the embodiment illustrated, the upper arm 152 includes ridges around both an external and an internal perimeter (around a slot therein) thereof to increase rigidity of the upper arm 152 and includes a plurality of fastening holes for mounting the door 30 (FIGS. 1 and 2) thereto with fasteners.

As can be seen in FIG. 4, in various embodiments, the hinge bracket 110 includes a catch plate 116 extending between the bracket arms 114. In the embodiment illustrated, the catch plate 116 connects to the bracket arms 114. However, in other various embodiments, the catch plate 116 connects between the base plates 112. As can be seen in FIGS. 5 and 6, the catch plate 116 is positioned on a plane that is different to the base plate 112, offset in a direction that the bracket arms 114 extend.

The catch plate 116 is adapted to obstruct and catch an end of the lower arm 160 to halt further rotation of the hinge arm 150 and to define the open position of the hinge 100. In the embodiment illustrated in FIGS. 5 and 6, the bracket arms 114 and the catch plate 116 are a unitarily formed U-shaped structure and the base plates 112 are L shaped brackets connected to each side thereof. In some various embodiments, the catch plate 116 is adapted to hold the upper arm 152 and the door 30 in a horizontal orientation. In such an orientation, an interior of the door 30 can be utilized as a work surface for assembly equipment being removed from the storage bin 20, and the like. Alternatively, the catch plate 116 can be positioned such that the door 30 rotates beyond a horizontal orientation to ensure that the interior of the door 30 is not used as a work surface when such use would be undesirable.

Figure 9:
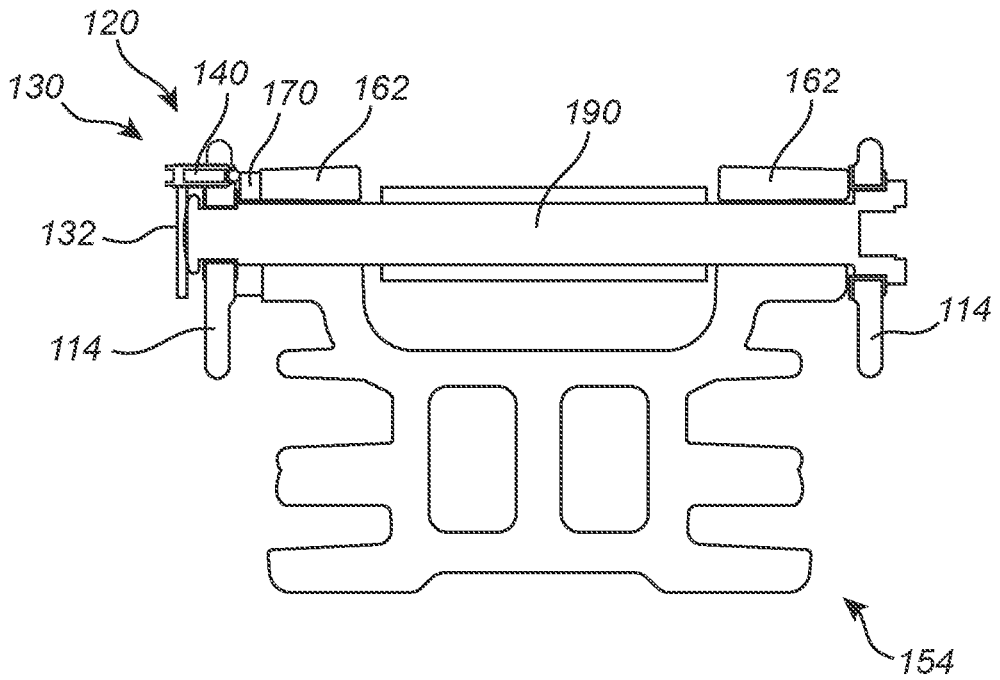
FIG. 9 is a cross-sectional view of the illustrative embodiment of the hinge of FIG. 3 taken along the line IX-IX of FIG. 7.

FIG. 9 is a cross-sectional view of the illustrative embodiment of the hinge of FIG. 3 taken along the line IX-IX of FIG. 7. Referring now specifically to FIG. 9, in various illustrative embodiments, the plunger assembly 130 includes one or more plungers 140 adapted to bias towards the detent plate 170. In the embodiment illustrated, the plunger assembly 130 includes a support plate 132 that is adapted to support a distal end of the one or more plungers 140 relative to the detent plate 170.

Figure 10:
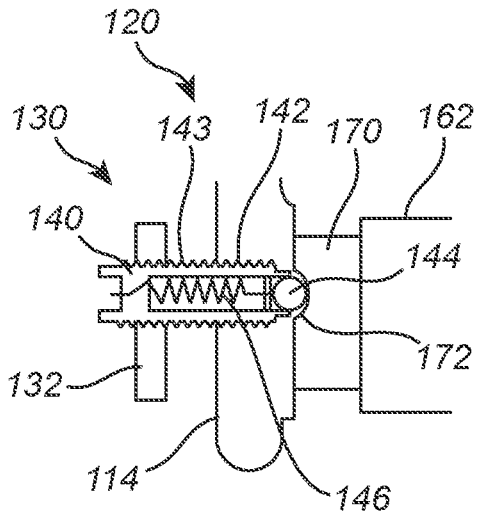
FIG. 10 is a detailed view of the illustrative embodiment of the hinge of FIG. 3 highlighting the detent assembly in an open position.

FIG. 10 is a detailed view of the illustrative embodiment of the hinge of FIG. 3 highlighting the detent assembly 120 in an open position. Referring now specifically to FIG. 10, in various embodiments, the detent plate 170 forms at least one recess 172 for each of the one or more plungers 140, the at least one recess 172 defining a detent position, and in particular, an orientation of the hinge arm 150 relative to the hinge bracket 110 when the plunger 140 catches at the recess 172.

Each plunger 140 includes a body 142, an end 144, and a biasing member 146. The body 142 is secured in the axial direction, relative to an axis of the hinge pin 190. In the embodiment illustrated, the body 142 is hollow and is adapted to hold the biasing member 146 therein. The end is biased towards the detent plate 170. In particular, the end 144 is biased at least partially into the recess while the ball is circumferentially aligned (relative to the axis of the hinge pin 190) with the recess, and the end 144 is biased into contact with the outer surface 174 of the detent plate 170 while circumferentially offset from the recess 172. In the embodiment illustrated in FIGS. 9-11, the end 144 is a ball. However, other types of contact components are also contemplated.

The biasing member 146 is adapted to bias the end 144 towards the detent plate 170. In the embodiment illustrated, the biasing member 146 is a coil spring, however, other types of springs and biasing elements are also contemplated. In some embodiments, the body 142 includes external threads. The external threads are adapted for adjusting the axial position of the plunger 140. By changing the axial position of the plunger 140, the amount of biasing force applied by the biasing member 146 to the end 144, and thus, the force applied by the plunger 140 on the detent plate 170, can be adjusted (due to the compression/decompression of the biasing member 146). Such adjustment allows for the amount of force needed to move the door 30 out of the detent position to be increased or decreased depending on the preferences of the vehicle owner.

Figure 11:
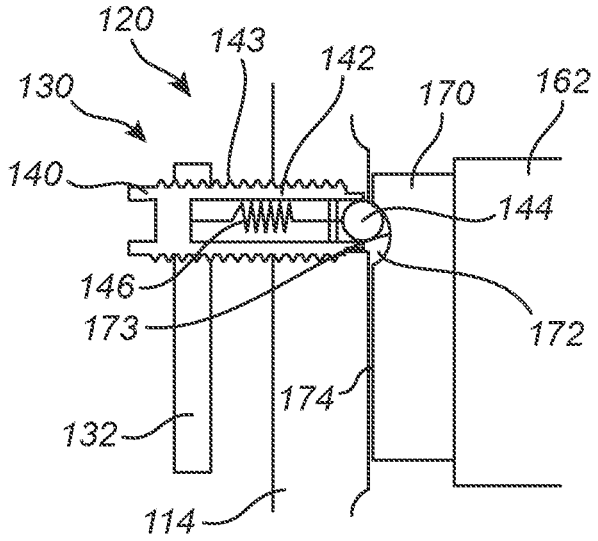
FIG. 11 is a detailed view of the illustrative embodiment of the hinge of FIG. 3 highlighting the detent assembly in a detent position.

FIG. 11 is a detailed view of the illustrative embodiment of the hinge of FIG. 3 highlighting the detent assembly in a detent position. Referring now specifically to FIG. 11, in various embodiments, the recess 172 includes an interference surface 173 that is angled to, at least partially, extend in the axial direction, such that the interference surface 173 obstructs relative circumferential movement between the plunger 140 and the detent plate 170. In the embodiment illustrated, the plunger assembly 130 is the static portion of the detent assembly 120 that is secured to the hinge bracket 110, such as to a bracket arm 114, while the detent plate 170 is the rotor portion of the detent assembly 120 that is secured to the hinge arm 150, such as to the mounting portion 162 of the lower arm 160.

In the embodiment illustrated, rotation of the detent plate 170 is obstructed by the end 144 of each plunger 140 due to the interference between the respective interference surface 173 and end 144. Such obstruction remains until sufficient force is applied, which overcomes the biasing force of the biasing member 146 and the interference surface 173 pushes the end 144 towards the body 142 of the plunger 140. After which, the end 144 slides along an outer surface 174, which faces axially, while the hinge arm 150 is rotated. In various other embodiments, the detent plate 170 is static and the plunger assembly 130 is adapted to rotate. However, the same interference between the interference surface(s) 173 and the end(s) 144 occur to obstruct the relative rotation therebetween while the hinge arm 150/door 30 are in the detent position.

Figure 12:
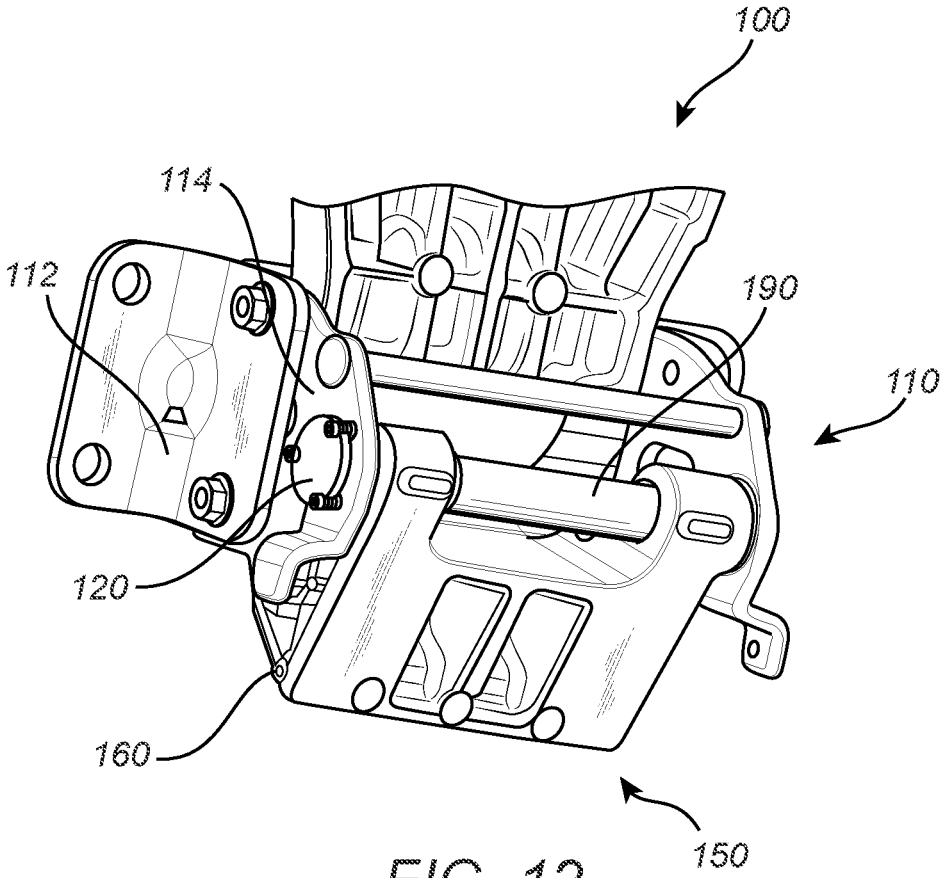
FIG. 12 is a perspective view of another illustrative embodiment of the hinge of the present disclosure highlighting an embodiment of the detent assembly.

FIG. 12 is a perspective view of another illustrative embodiment of the hinge 100 of the present disclosure highlighting an embodiment of the detent assembly 120. Referring now specifically to FIG. 12, in various illustrative embodiments, the detent assembly 120 includes multiple plungers 140, and in the particular embodiment shown, the detent assembly 120 includes three plungers 140.

Figure 13:
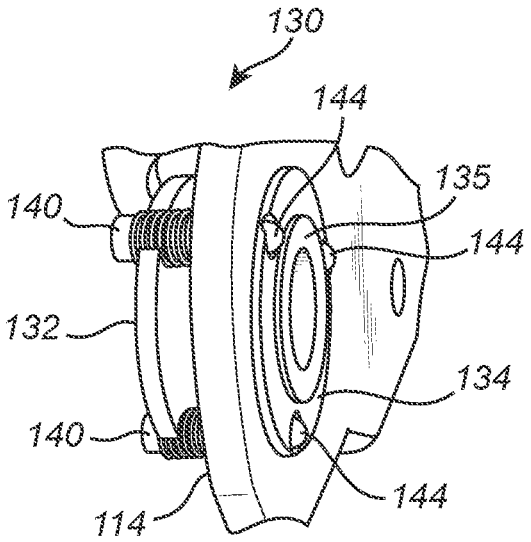
FIG. 13 is a perspective view of an illustrative embodiment of the plunger assembly of the detent assembly of FIG. 12.

FIG. 13 is a perspective view of an illustrative embodiment of the plunger assembly 130 of the detent assembly 120 of FIG. 12. Referring now specifically to FIG. 13, in the embodiment illustrated, the plunger assembly 130, along with the plungers 140 and the support plate 132, also includes a base 134 offset from the support plate 132. In the embodiment illustrated, the base 134 includes an annular protrusion 135 that extends therefrom in the biasing direction, away from the support plate 132, and towards the detent plate 170. In various embodiments, the annular protrusion 135 is adapted to reduce any contact between the plunger assembly 130 and the detent plate 170, which reduces friction and ensures that relative rotation between the hinge bracket 110 and the hinge arm 150 is uninhibited outside of the initial inhibition at the detent position(s). In the embodiment illustrated, the base 134 is secured to the bracket arm 114.

Figure 14:
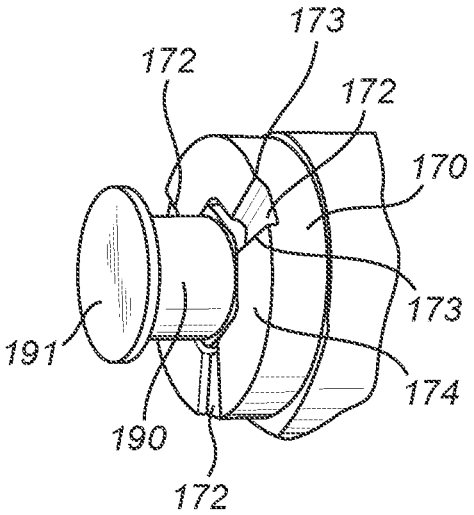
FIG. 14 is a perspective view of an illustrative embodiment of the detent plate of the detent assembly of FIG. 12.

FIG. 14 is a perspective view of an illustrative embodiment of the detent plate of the detent assembly of FIG. 12. Referring now specifically to FIG. 14, in the embodiment illustrated, the detent plate 170 generally includes a hollow cylinder shape, such as an annulus, that includes the axially facing outer surface 174 that is adapted to contact the ends 144 of the plungers 140 as well as the annular protrusion 135. In the embodiment illustrated, three recesses 172 are formed in the annular body of the detent plate 170, which each define an interference surface 173. In various embodiments, each recess 172 defines an interference surface 173 on each side, such that the detent position is formed in both rotational directions of the hinge arm 150.

While the embodiment illustrated shows one set of three recesses 172 (one for each plunger 140) to define a single detent position, in various embodiments, multiple sets of the recesses 172 are formed in the annular body of the detent plate 170 defining multiple detent positions. For example, it may be desirable to have a detent position every 30 degrees of rotation of the hinge arm 150/door 30. In such a case, each set of recesses 172 is clocked 30 degrees relative the adjoining sets of recesses 172. While the above example describes the clocking at 30 degrees, any angle for the clocking can be selected in accordance with the present disclosure.

Figure 15:
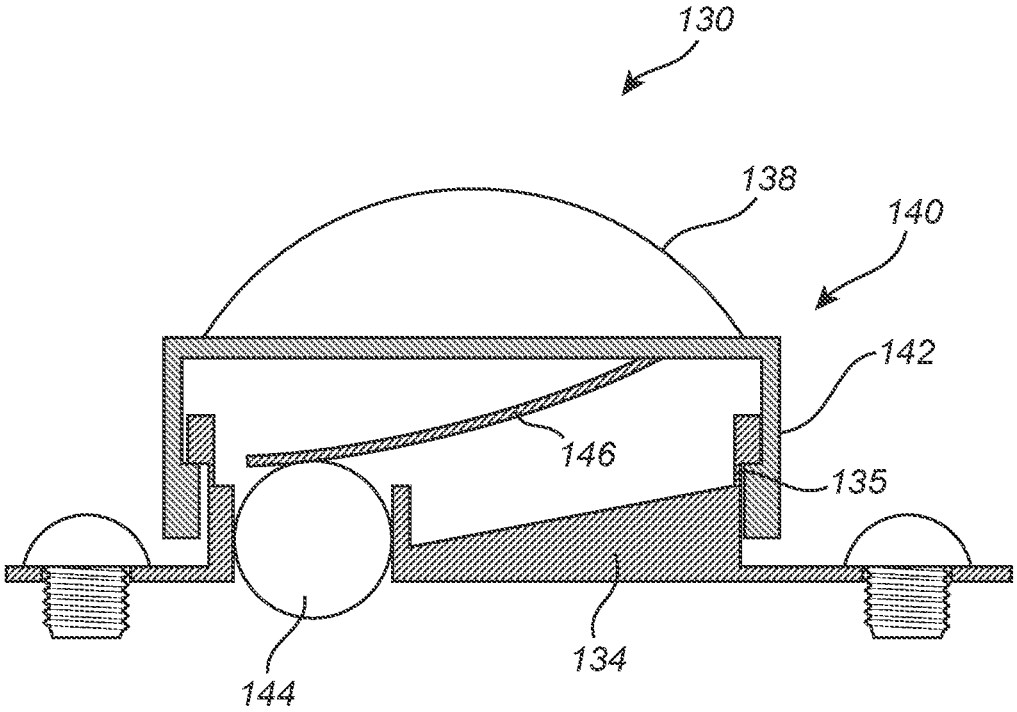
FIG. 15 is a cross-sectional view of one illustrative embodiment of an engaging mechanism for the detent assembly of the present disclosure.

FIG. 15 is a cross-sectional view of one illustrative embodiment of an engaging mechanism for the detent assembly of the present disclosure. Referring now specifically to FIG. 15, in various illustrative embodiments, the biasing member 146 is a leaf spring and the end 144 is a ball held in position by the base 134. In the embodiment illustrated, the plunger assembly 130 includes a plunger 140 with a knob 138 connected to an end of the body 142. The base 134 is integrated into plunger 140 and includes an attachment arm 135 extending axially therefrom. In various embodiments, the attachment arm 135 includes a hollow cylinder that is adapted to mate with a portion of the body 142.

In various embodiments, the attachment arm 135 and the body 142 include radially overlapping protrusions to maintain an assembly therebetween. In various embodiments, at least one of the body 142 and the attachment arm 135 includes detent positions therein for the corresponding protrusions. These detent positions define circumferential positions of the body 142 for engaging and disengaging the biasing member 146.

In the embodiment illustrated, the biasing member 146 is a leaf spring, such as a helically shaped leaf spring that biases the end 144, such as a ball, away from the knob 138 and towards the detent plate 170. The leaf spring extends from the body such that upon rotation, the leaf spring disengages from the ball so as to remove the biasing force therefrom. While a single leaf spring and ball are shown in FIG. 15, in various embodiments, multiple leaf springs and corresponding balls are utilized.

Various other embodiments for engaging and disengaging the detent assembly 120 are also contemplated. For example, in various embodiments, such as those disclosed in FIGS. 9-11, each individual plunger 140 can be rotated to be moved axially, via the threads to engage/disengage the end 144 thereof and to change the amount of force applied thereby (thus changing the force required to rotate the hinge arm 150 out of the detent position). Similarly, the entire plunger assembly 130 and/or the detent plate 170 can be axially movable between an engaged and a disengaged position in order to allow the detent position of the hinge 150 to be engaged and disengaged by an operator thereof.

Again, the detent assembly 120 provides one or more detent positions for the door 30 of the vehicle storage bin 20. By providing one or more detent positions for the door 30, the door can be prevented from swinging completely open from the closed position to the open position upon release of a latch securing the door closed. By preventing the door from swinging open, such as due to the weight of the door from gravity, the door can be prevented from impacting a person or object next to the door. Furthermore, with the detent position, a person is able to access the contents in the vehicle storage bin 20 without fully opening the door to the open position without the need to hold the door in that intermediate position due to the detent position caused by the detent assembly 120. Thus, when space is tight between the vehicle 10 and another object/vehicle, access to the vehicle storage bin 20 is still easily managed.

In some instances, one or more components may be referred to herein as "configured to," "configured by," "configurable to," "operable/operative to," "adapted/adaptable," "able to," "conformable/conformed to," etc. Those skilled in the art will recognize that such terms (for example "configured to") generally encompass active-state components and/or inactive-state components and/or standby-state components, unless context requires otherwise.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (for example, bodies of the appended claims) are generally intended as "open" terms (for example, the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (for example, "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (for example, the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (for example, "a system having at least one of A, B, and C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

Although the present disclosure is illustrated and described herein with reference to illustrative embodiments and specific examples thereof, it will be readily apparent to those of ordinary skill in the art that other embodiments and examples may perform similar functions and/or achieve like results. All such equivalent embodiments and examples are within the spirit and scope of the present disclosure, are contemplated thereby, and are intended to be covered by the following non-limiting claims for all purposes.

What is claimed is:

1. A hinge comprising:

a hinge arm rotatably connected to a hinge bracket via a hinge pin, wherein the hinge bracket comprises bracket arms each coupled to a base plate, a catch plate extending between the bracket arms, and the hinge pin is disposed between the bracket arms through the hinge arm and received in each of the bracket arms, wherein the hinge arm is an integral component that comprises an upper hinge arm having a plurality of fastening holes for mounting a door and disposed on a side of the hinge pin between the bracket arms, a lower hinge arm configured to engage the catch plate to halt rotation of the hinge arm and disposed on another side of the hinge pin between the bracket arms, and a mounting portion configured to form a coupling between the hinge arm and the hinge pin and disposed between the upper hinge arm and the lower hinge arm between the bracket arms; and a detent assembly adapted to define a detent position of the hinge arm relative to the hinge bracket that is between an open position and a closed position of the hinge arm relative to the hinge bracket, the detent assembly including:

a detent plate including a recess formed therein; and a plunger assembly including an end that is biased at least partially into the recess at the detent position.

2. The hinge of claim 1, wherein the end includes a ball biased towards the detent plate by a biasing member such that the ball is configured to be 1) biased at least partially into the recess while circumferentially aligned with the recess and 2) biased with an outer surface of the detent plate while circumferentially offset from the recess.

3. The hinge of claim 2, wherein the ball is biased at least partially into the recess, and wherein contact between the ball and a side of the recess interfere with movement of the hinge arm relative to the hinge bracket.

4. The hinge of claim 2, wherein the plunger assembly includes a base adapted to connect to the hinge bracket and the base includes an annular protrusion extending therefrom, towards the detent plate.

5. The hinge of claim 1, wherein the detent assembly is adjustable to disengage the plunger assembly from the detent plate such that the end is not biased into the recess while the detent assembly is in a disengaged orientation.

6. The hinge of claim 1, wherein the plunger assembly is a static assembly and is mounted to the hinge bracket, and wherein the detent plate is a rotor that is mounted to the hinge arm and is adapted to rotate with the hinge arm.

7. The hinge of claim 1, wherein the plunger assembly includes a leaf spring adapted to bias the end, comprising a ball, towards the hinge plate, and wherein the leaf spring is rotatable by a knob such that the leaf spring is disengaged from the ball upon rotation of the knob.

8. A door assembly comprising:

a door adapted to provide access to a storage bin; and a hinge comprising:

a hinge bracket adapted to connect to a structure of the storage bin, a hinge arm rotatably connected to the hinge bracket via a hinge pin and disposed through a slot formed in the door and connected to an interior portion of the door, wherein the hinge bracket comprises bracket arms each coupled to a base plate adapted to be coupled to the structure of the storage bin, a catch plate extending between the bracket arms, and the hinge pin is disposed between the bracket arms through the hinge arm and received in each of the bracket arms, wherein the hinge arm is an integral component that comprises an upper hinge arm having a plurality of fastening holes for mounting the door and disposed on a side of the hinge pin between the bracket arms, a lower hinge arm configured to engage the catch plate to halt rotation of the hinge arm and disposed on another side of the hinge pin between the bracket arms, and a mounting portion configured to form a coupling between the hinge arm and the hinge pin and disposed between the upper hinge arm and the lower hinge arm between the bracket arms, and a detent assembly adapted to define a detent position of the door that is between an open position and a closed position of the door, the detent assembly including a detent plate including a recess formed therein and a plunger assembly including an end that is biased at least partially into the recess at the detent position.

9. The door assembly of claim 8, wherein the door assembly is adapted to open the door in a downward direction relative to the storage bin.

10. The door assembly of claim 8, wherein the detent assembly is adjustable to disengage the plunger assembly from the detent plate such that the end is not biased into the recess while the detent assembly is in a disengaged orientation, such that the door rotates freely between the open position and the closed position while the plunger assembly is disengaged.

11. The door assembly of claim 8, wherein the plunger assembly is a static assembly and is mounted to the hinge bracket, and wherein the detent plate is a rotor that is mounted to the hinge arm and is adapted to rotate with the hinge arm.

12. The door assembly of claim 8, wherein the plunger assembly includes one or more plungers including a body, a biasing member held therein, and the end is a ball biased in an axial direction relative to the hinge pin away from the body and towards the detent plate.

13. The door assembly of claim 12, wherein the body includes external threads such that the body is movable in the axial direction.

14. The door assembly of claim 8, wherein the plunger assembly includes a base adapted to connect to the hinge bracket and the base includes an annular protrusion extending therefrom, towards the detent plate.

15. A vehicle comprising:

a storage bin accessible at an exterior of the vehicle;

a door adapted to provide access to the storage bin; and a hinge comprising:

a hinge bracket adapted to connect to a structure of the vehicle, a hinge arm rotatably connected to the hinge bracket via a hinge pin and disposed through a slot formed in the door and connected to an interior portion of the door, wherein the hinge bracket comprises bracket arms each coupled to a base plate adapted to be coupled to the structure of the vehicle, a catch plate extending between the bracket arms, and the hinge pin is disposed between the bracket arms through the hinge arm and received in each of the bracket arms, wherein the hinge arm is an integral component that comprises an upper hinge arm having a plurality of fastening holes for mounting the door and disposed on a side of the hinge pin between the bracket arms, a lower hinge arm configured to engage the catch plate to halt rotation of the hinge arm and disposed on another side of the hinge pin between the bracket arms, and a mounting portion configured to form a coupling between the hinge arm and the hinge pin and disposed between the upper hinge arm and the lower hinge arm between the bracket arms, and a detent assembly adapted to define a detent position of the door that is between an open position and a closed position of the door, the detent assembly including a detent plate including a recess formed therein and a plunger assembly including an end that is biased at least partially into the recess at the detent position.

16. The vehicle of claim 15, wherein the door is positioned in a side panel of the vehicle, the door being adapted to open outward in a direction away from the vehicle.

17. The vehicle of claim 16, wherein the hinge is adapted to open the door in a downward direction relative to the vehicle.

18. The vehicle of claim 15, wherein the detent assembly is adjustable to disengage the plunger assembly from the detent plate such that the end is not biased into the recess while the detent assembly is in a disengaged orientation, such that the door rotates freely between the open position and the closed position while the plunger assembly is disengaged.

19. The vehicle of claim 15, wherein the plunger assembly is a static assembly and is mounted to the hinge bracket, and wherein the detent plate is a rotor that is mounted to the hinge arm and is adapted to rotate with the hinge arm.

20. The vehicle of claim 15, wherein the plunger assembly includes one or more plungers including a body, a biasing member held therein, and the end is a ball biased in an axial direction relative to the hinge pin away from the body and towards the detent plate.

* * * * *